US005529254A

United States Patent [19]

McIntyre et al.

[11] Patent Number: 5,529,254

[45] Date of Patent: Jun. 25, 1996

[54] SYSTEM AND METHOD FOR CHANGING SIZING SCREEN IN MATERIALS PROCESSOR

[75] Inventors: Murray McIntyre, Burns Flat, Okla.; Jerome Gallo, New Berlin, Wis.

[73] Assignee: Rexworks, Inc., Milwaukee, Wis.

[21] Appl. No.: 237,656

[22] Filed: May 4, 1994

[51] Int. Cl.[6] ..... B02C 23/00; B24B 41/00

[52] U.S. Cl. ..... 241/285.3; 209/409; 209/413; 209/402.08

[58] Field of Search ..... 209/405, 409, 209/412, 413; 29/402.08, 426.5; 241/285.3, 285.1, 285.2

[56] References Cited

U.S. PATENT DOCUMENTS 4,175,710 11/1979 Robertson ..... 241/285.3 X 4,505,812 3/1985 Lees ..... 209/405 X 5,344,088 9/1994 Page ..... 241/282

*Primary Examiner*—William E. Terrell

*Assistant Examiner*—Tuan Nguyen

*Attorney, Agent, or Firm*—Reinhart, Boerner, Van Deuren, Norris & Rieselbach

[57] ABSTRACT

A materials grinding and processing machine includes a sizing concave having a sizing screen contained therein. Ordinarily, the sizing concave is pivotally connected adjacent its upper end to the frame of the materials processing machine. To replace the sizing screen, a temporary pivotal connection is made between the lower end of the sizing concave and the frame. The upper end of the sizing concave is permitted to swing away from the frame to provide access to the sizing screen from above. A hydraulic cylinder, coupled between the frame and the sizing concave, can be selectively attached at different points on the sizing concave to move the sizing concave and improve access, from above, to the sizing screen.

7 Claims, 4 Drawing Sheets

SYSTEM AND METHOD FOR CHANGING SIZING SCREEN IN MATERIALS PROCESSOR

BACKGROUND OF THE INVENTION

This invention relates generally to materials grinding and processing machines and, more particularly, to systems and methods for changing sizing screens in such machines.

Waste disposal, and in particular, the disposal of construction, demolition and similar debris, is a serious and growing problem. Although such debris consists principally of relatively clean, non-hazardous materials such as pavement, bricks, lumber, shingles, glass and the like, the shear bulk of such materials can make their disposal a challenge. Accordingly, various machines have been developed for grinding, shredding and otherwise reducing such materials to a more compact and easily handled form.

In one form of materials processing machine, such as that shown in U.S. patent application Ser. No. 07/778,322, filed Oct. 17, 1991, now U.S. Pat. No. 5,344,088, entitled "Materials Grinder" and commonly owned by the assignee hereof, improved grinding and shredding action is achieved through use of a sizing screen concave which positions a sizing screen adjacent a rotary hammer or drum to further process partially comminuted material. Although effective, the sizing screen is subjected to terrific punishment and must be reversed and replaced from time to time. Different forms of sizing screens can be installed to vary the final product size. For these, reasons, it is necessary to change sizing screens several times in the life of a materials processing machine.

Typically, several hours were required to change a sizing screen in a materials processing machine of the type shown in U.S. patent application Ser. No. 07/778,322. Not only do labor costs associated with changing a sizing screen become significant when considerable time is required to change the screen, but the machine is out of service and, hence, unproductive during this time. There is a need, therefore, to reduce and minimize the time required to change sizing screens in a materials processing machine.

SUMMARY OF THE INVENTION

The invention provides a method of changing a sizing screen in a materials processing machine of the type having a sizing concave pivotally attached at its upper end to a frame and further having a hydraulic cylinder coupled between the frame and the sizing concave to move the sizing concave around the pivot, the sizing screen being mounted within the sizing concave. The method comprises the steps of pivotally connecting the sizing concave at its lower end to the frame and releasing the pivotal connection between the upper end of the sizing concave and the frame. The method further includes the step of pivoting the sizing concave around the lower pivotal connection to allow relative lateral movement at the upper end of the sizing concave to provide access from above to the sizing screen.

In one embodiment, the hydraulic cylinder is detached from the sizing concave and is reattached at a different point on the sizing concave to improve access to the sizing screen contained within the sizing concave.

The invention also provides a material processing machine having a sizing screen quick-change capability. The materials processing machine includes a frame and a sizing concave pivotally connected at its upper end to the frame. The machine further includes a sizing screen mounted on the sizing concave and a hydraulic cylinder coupled between the frame and the sizing concave. A selectively engagable pivot adjacent the lower end of the sizing concave is provided for temporarily pivotally connecting the sizing concave to the frame adjacent the lower end of the sizing concave.

In one embodiment, the hydraulic cylinder can be coupled to either one of a primary and secondary point of attachment on the sizing concave.

It is an object of the present invention to provide a new and improved system and method for changing sizing screens in a materials processing machine.

It is a further object of the present invention to provide a new and improved system for changing sizing screens in a materials processing machine that is quick and convenient and avoids placing the materials processing machine out of operation for extended periods of time.

BRIEF DESCRIPTION OF THE DRAWINGS

The features of the present invention that are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 1:
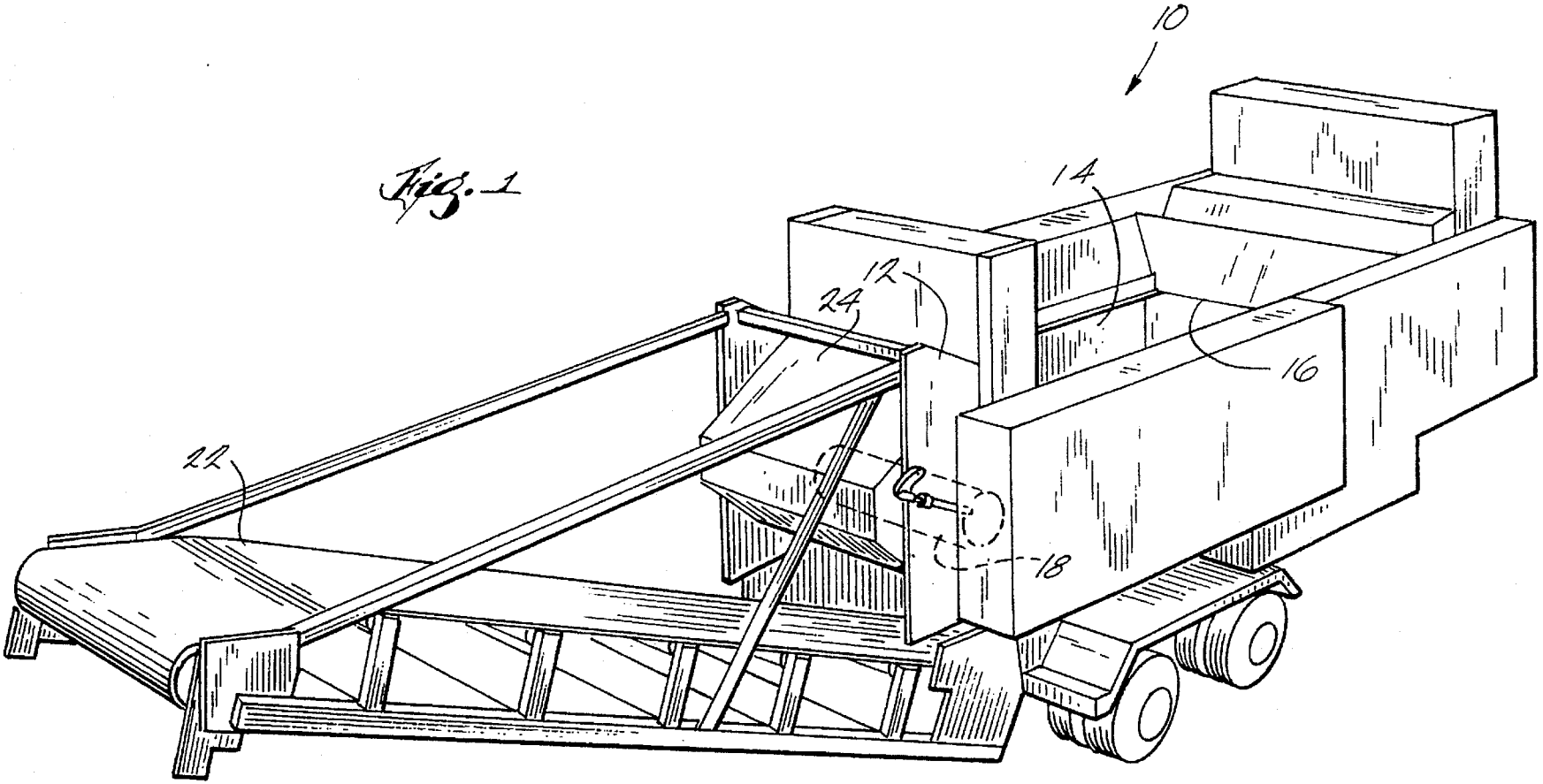
FIG. 1 is a perspective view of a materials processing machine having a sizing concave containing a sizing screen within.

Referring to the drawings, a materials grinding and processing machine 10 is shown in FIG. 1. The materials grinding and processing machine 10, which preferably is of the type shown in co-pending U.S. patent application Ser. No. 07/778,322 the specification of which is incorporated by reference herein, functions broadly to convert bulky solid materials, such as pavement, bricks, lumber, shingles, glass and the like into a shredded, ground or otherwise more compact and easily handled form. The machine 10 generally includes a frame 12 and a hopper 14 for receiving the materials to be processed. A ram 16 at one end of hopper 14 forces the materials toward a rotary drum or hammer 18 located at the other end of the hopper 14. The rotary drum or hammer 18, in conjunction with a cutting bar (not shown) and a sizing screen 20 (FIG. 2) shreds, grinds or otherwise comminutes the materials. The comminuted materials are then discharged onto a conveyor 22 for removal. The sizing screen 20 is mounted within a sizing concave 24 mounted adjacent the discharge end of the materials grinding and processing machine 10.

Figure 2:
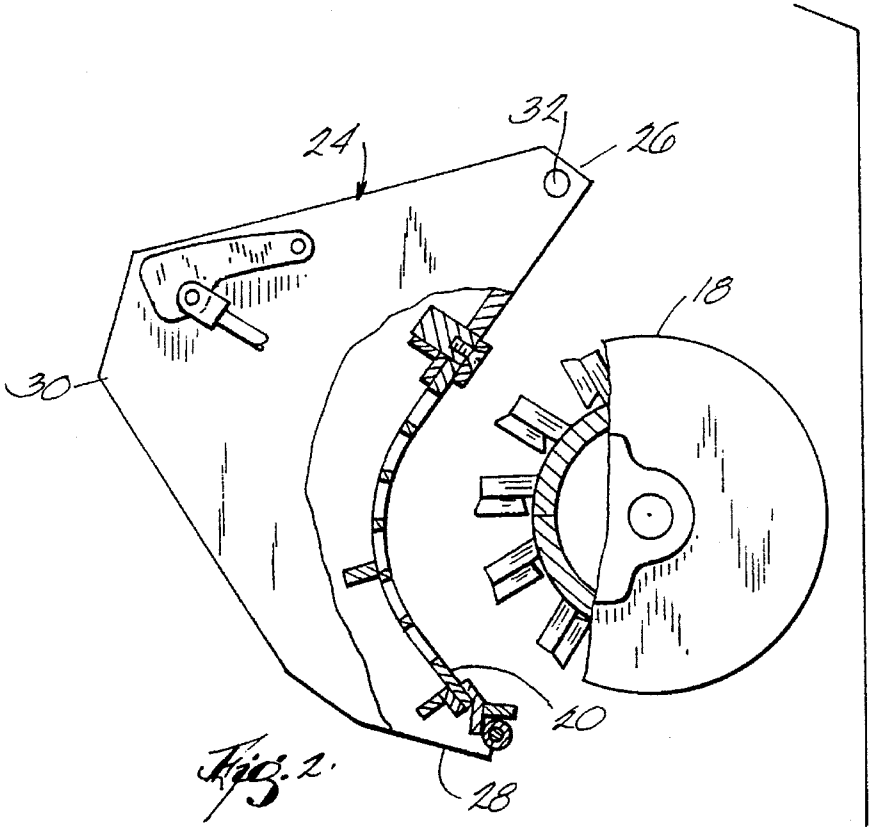
FIG. 2 is a side view, partially in section, of the sizing concave contained in the materials processing machine shown in FIG. 1.
Figure 4:
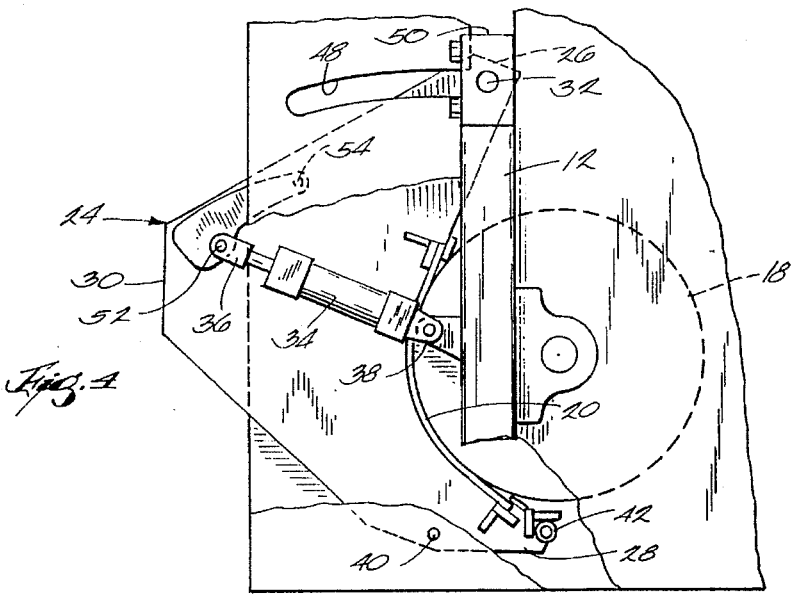
FIG. 4 is a diagrammatic side view of the sizing concave shown in an operating position prior to changing the sizing screen in accordance with the system mad method of the present invention.

Referring to FIGS. 2 and. 3, the sizing screen 20 comprises an arcuate, foraminous plate conforming generally to the outer circumferential periphery of the rotary drum or hammer 18. The sizing screen 20 has a generally rectangular outer periphery and is mounted within the sizing concave 24 in alignment with the rotary drum or hammer 18. Although the spacing between the sizing screen 20 and rotary drum 18 has been exaggerated in FIG. 2 for clarity, the sizing screen 20, in ordinary use, lies closely adjacent the rotary drum 18 (see FIG. 4). During operation, the materials to be processed are further broken up and reduced by passing between the rotary drum or hammer 18 and the sizing screen 20. As the materials are reduced to a size sufficiently small to pass through the perforations in the sizing screen 20, the materials fall from the sizing concave 24 onto the conveyor 22.

Figure 3:
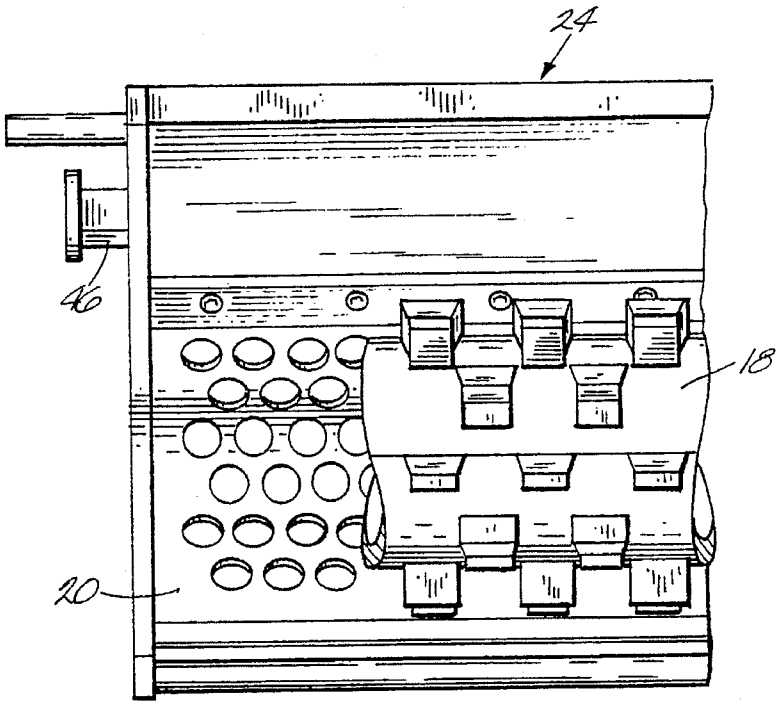
FIG. 3 is a fragmentary front elevation view of the sizing concave contained in the materials processing machine of FIG. 1.

Referring further to FIGS. 2 and 3, the sizing concave 24 is roughly triangular in cross section and includes an upper end 26, a lower end 28 and an outer end 30. The sizing screen 20 is positioned across the sizing concave 24 roughly between the upper and lower ends 26, 28. The sizing concave 24 is pivotally joined adjacent the upper end 26 to the frame 12 of the materials grinding and processing machine 10 for movement around an upper pivot axis 32. In ordinary use, the sizing concave 24 can rotate around this upper pivot 32 so that the lower end 28 of the sizing concave 24 can swing away from the rotary drum or hammer 18. This permits large ungrindable materials to pass through the rotary drum or hammer 18 without jamming the machine. A hydraulic cylinder 34 (FIG. 4) having one end 36 coupled to the sizing concave 24 and another end 38 coupled to the frame 12 of the materials grinding and processing machine 10 biases the sizing concave 24 toward the rotary drum or hammer 18 to hold the sizing screen 20 in close proximity to the rotary drum or hammer 18 during normal operation. In the event a large, ungrindable chunk of material is encountered, the hydraulic cylinder 34 allows the sizing concave 24 temporarily to swing away from the rotary drum or hammer 18 to permit passage of the chunk. Thereafter, the sizing concave 24 returns to the normal operating position.

Typically, the sizing screen 20 is formed of a thick metal plate (e.g., one inch steel) and weighs several hundred pounds. Because of the harsh environment in which it works, the sizing screen 20 is subjected to terrific punishment and wear and can need frequent replacement. Similarly, different size apertures in the sizing screen 20, are desirable depending on the materials to be ground and the desired size of the comminuted final product. Finally, extended sizing screen life can be achieved by periodically reversing the sizing screen 20 end-for-end so as to promote more even and balanced wear. For these reasons, it is frequently necessary to remove the sizing screen 20 from the sizing concave 24.

The complete removal and disassembly of the sizing concave 24 is a complicated task that requires several hours to perform. To reduce this time, the materials grinding and processing machine 10 is configured to provide a "quick-change" procedure for removing, replacing or otherwise changing the materials processing sizing screen 20.

The "quick-change" method for changing the sizing screen 20 is illustrated in FIGS. 4–8. From the initial, ordinary operating position shown in FIG. 4, the sizing concave 24 is first pivoted around the upper pivot 32 to a partially open position Shown in FIG. 5. In the illustrated embodiment, the sizing concave 24 is moved to this position by partially extending the hydraulic cylinder 34.

Figure 5:
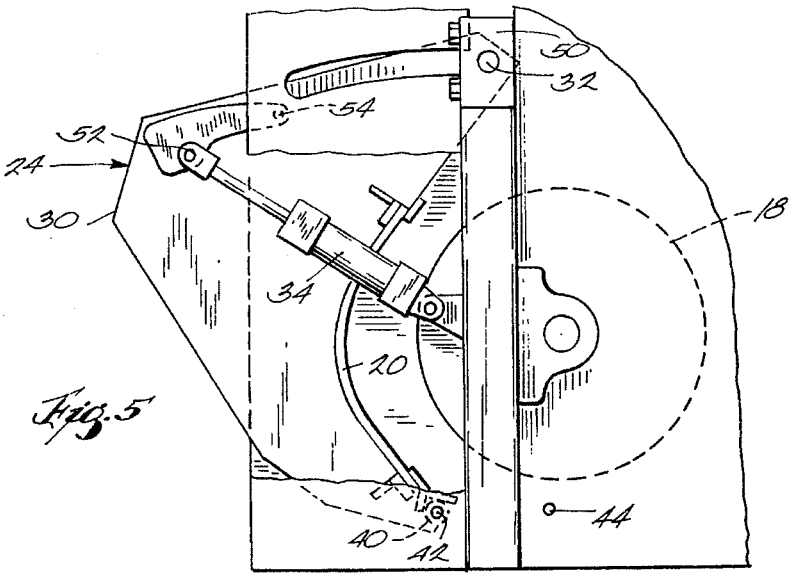
FIG. 5 is a diagrammatic view similar to FIG. 4 showing the sizing concave moved to a position where it is temporarily pivotally connected adjacent its lower end to the frame of the materials processing machine.
Figure 6:
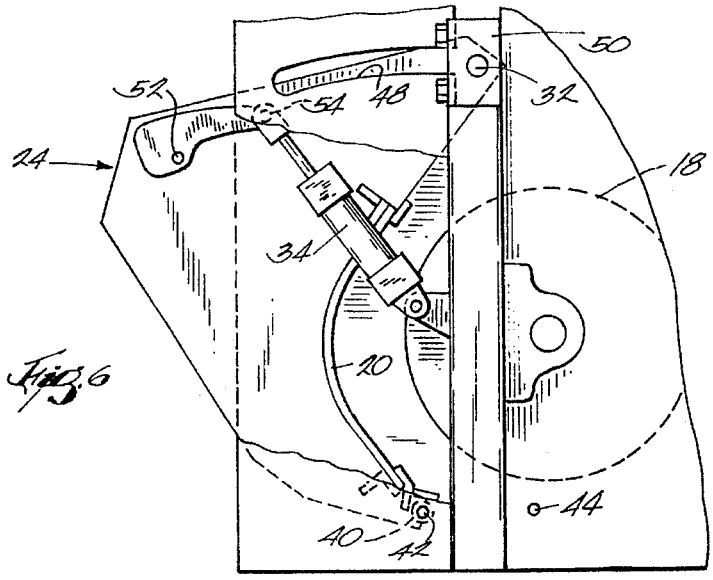
FIG. 6 is diagrammatic view similar to FIG. 5 wherein a hydraulic extension cylinder initially attached at one point on the sizing concave is retracted and reattached to a different point on the sizing concave.
Figure 7:
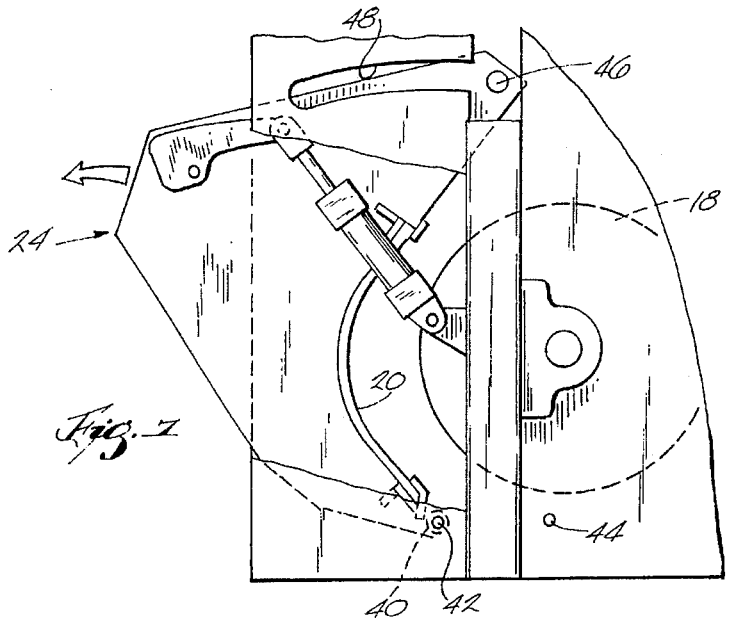
FIG. 7 is a diagrammatic view similar to FIG. 6 showing the hydraulic cylinder being extended to pivot the sizing concave around the temporary pivot to provide access from above to the sizing screen contained in the sizing concave.

After the sizing concave 24 is moved to the partially open position shown in FIG. 5, the lower end 28 of the sizing concave 24 is temporarily pivotally connected to the frame 12 of the materials grinding and processing machine 10. In the illustrated embodiment, the temporary, lower pivotal connection is made using coaxially alignable holes 40 formed in both the frame 12 and the lower end 28 of the sizing concave 24. When the sizing concave 24 is in the partially open position shown in FIG. 5, the holes 40 formed in both the lower end 28 of the sizing concave 24 and the frame 12 are coaxially aligned. Next, a removable pivot pin 42 is inserted through the aligned holes 40 to pivotally secure the lower end 28 of the sizing concave 24 to the frame 12. In the illustrated embodiment, it will be understood that two such pairs of coaxially alignable holes 40 are provided, one pair in each side of the sizing concave 24. It will also be understood that two pivot pins 42 are similarly provided. When the pivot pins 42 are not being used to pivotally secure the lower end 28 of the sizing concave 24 to the frame 12 as shown in FIG. 5, the pins 42 are stored in additional holes 44 formed in the frame 12.

After the sizing concave 24 is temporarily pivotally secured adjacent its lower end 28 to the machine frame 12, the pivotal connection 32 at the upper end 26 of the sizing concave 24 is released to permit the upper end 28 of the sizing concave 24 to swing away from the rotary drum or hammer 18 and thereby provide access to the sizing screen 20 from above. In the illustrated embodiment, the pivoting connection 32 at the upper end 26 of the sizing concave 24 is provided by means of a pin 46 extending outwardly from the upper end 26 of the sizing concave 24. One such pin 46 is provided at each side of the sizing concave 24. The pins 46, in turn, extend through arcuate slots 48 formed in the machine frame 12. Ordinarily, the pins 46 are prevented from moving laterally along the slots 48 by means of removable keepers 50 bolted to the machine frame 12. With the keepers 50 in place, the pins 46 are blocked against lateral movement but the sizing concave 24 is nevertheless permitted to pivot around the pins 46. With the keepers 50 removed (FIG. 7) the pins 46 are free to travel laterally within the slots 48 to permit lateral movement between the upper end 26 of the sizing concave 24 and the frame 12 (FIG. 8).

Figure 8:
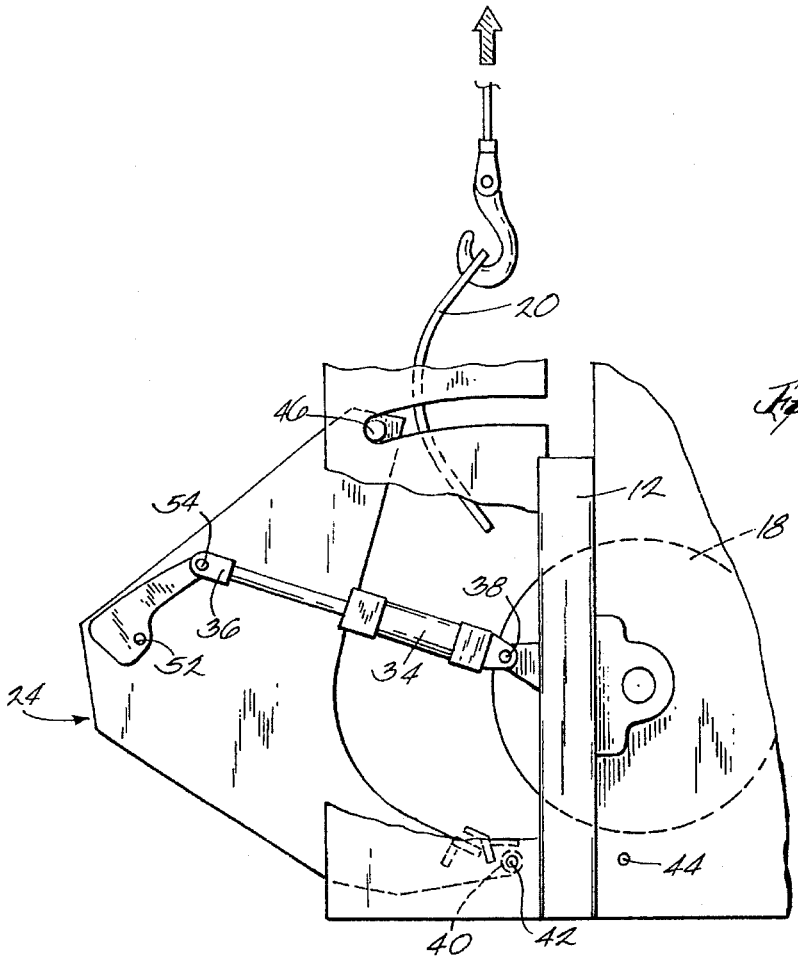
FIG. 8 is a diagrammatic view similar to FIG. 7 showing the sizing screen being lifted, from above, from the sizing concave.

By reference to FIG. 8, it will be appreciated how the use of a temporary pivot at the lower end 28 of the sizing concave 24 in conjunction with a temporary release of the pivot connection 32 at the upper end 36 of the sizing concave 24 provides sufficient access from above to enable removal and installation of the sizing screen 20 without requiring complete removal or disassembly of the sizing concave 24.

In the illustrated embodiment, movement of the sizing concave 24 can be facilitated by reconnecting the hydraulic cylinder 34 from a primary point of attachment 52 on the sizing concave 24 to a secondary point of attachment 54.

Specifically, after the sizing concave 24 has been moved to the partially open position shown in FIG. 5 and pivotally attached adjacent its lower end 28 to the frame 12, the end 36 of the hydraulic cylinder 34 is disconnected from its primary point of attachment 52 and is reattached to the secondary point of attachment 54. Thereafter, the upper pivot 32 is released (FIG. 7) and the hydraulic cylinder 34 is extended to move the sizing concave 24 to the fully open position shown in FIG. 8. Preferably, the secondary point of attachment 54 is located along a line segment extending between the primary point of attachment 52 and the upper pivot point 32. By reattaching the hydraulic cylinder 34 in this manner, the sizing concave 24 can be opened more fully than would be the case if the cylinder 34 were not so reattached.

Once the sizing screen 20 has been removed, different sizing screens can be dropped into place by reversing the steps shown in FIGS. 4–8. The system and method herein shown and described greatly reduces the time needed to replace a materials processing sizing screen 20. Specifically, complete removal of the sizing materials processing sizing screen 20. Specifically, complete removal of the sizing concave 24 is avoided, as are the difficulties associated with trying to replace the sizing screen 20 from below.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A method of changing a sizing screen in a materials processing machine of the type having a sizing concave pivotally attached at its upper end to a frame and further having a hydraulic cylinder coupled between the frame and the sizing concave to move the sizing concave around the pivot, the sizing screen being mounted within the sizing concave, said method comprising the steps of:

pivotally connecting the sizing concave at its lower end to the frame;

releasing the pivotal connection at the upper end of the sizing concave to allow relative lateral movement between the upper end of the sizing concave and the frame; and pivoting the sizing concave around the pivotal connection at the lower end of the sizing concave to provide access from above to the sizing screen therein contained.

2. A method as defined in claim 1 further comprising the step of detaching the hydraulic cylinder from a primary point of attachment on the sizing concave and reattaching the hydraulic cylinder to a secondary point of attachment on the sizing concave to provide increased access to the sizing screen contained in the sizing concave.

3. A method as defined in claim 2 wherein said secondary point of attachment is located substantially along a line segment extending between the primary point of attachment and the pivotal connection between the upper end of the sizing concave and the frame.

4. A method as defined in claim 3 wherein the hydraulic cylinder is moved from the primary point of attachment to the secondary point of attachment after the sizing concave is pivotally connected at the lower end to the frame and before the sizing concave is pivoted around the pivotal connection at the lower end of the sizing concave to provide access from above to the sizing screen therein contained.

5. A method as defined in claim 4 further comprising the steps of:

lifting the sizing screen from the sizing concave after the sizing concave has been pivoted around the pivotal connection at the lower end of the sizing concave;

lowering a sizing screen onto the sizing concave; and returning the sizing concave to an ordinary use position.

6. A method as defined in claim 5 wherein the sizing concave is returned to the use position by reversing the steps used to gain access from above to the sizing screen contained in the sizing concave.

7. A materials processing machine having a sizing screen quick-change capability, said materials processing machine comprising:

a frame;

a sizing concave pivotally connected at its upper end to said frame;

a sizing screen mounted on said sizing concave;

a hydraulic cylinder coupled between said frame and said sizing concave; and a selectively engagable pivot adjacent the lower end of said sizing concave for temporarily pivotally connecting said sizing concave to said frame adjacent said lower end of said sizing concave;

said selectively engagable pivot including a pair of coaxially alignable apertures formed, respectively, in said sizing concave and said frame and further including a pivot pin insertable in said coaxially alignable apertures;

said hydraulic cylinder being coupled at one end to said frame and at another end to either one of a primary and secondary point of attachment; and said secondary point of attachment being located substantially along a line segment extending between said primary point of attachment and said pivotal connection between said frame and said upper end of said sizing concave.

* * * * *